US006307326B1

(12) United States Patent
Elloway et al.

(10) Patent No.: US 6,307,326 B1
(45) Date of Patent: Oct. 23, 2001

(54) PROCEDURES AND APPARATUS FOR TURNING-ON AND TURNING-OFF ELEMENTS WITHIN A FIELD EMISSION DISPLAY DEVICE

(75) Inventors: Donald J. Elloway, Campbell; David L. Morris, San Jose; William J. Scannell; Christopher J. Spindt, both of Menlo Park, all of CA (US)

(73) Assignee: Candescent Technologies Corporation, San Jose, CA (US)

( * ) Notice: Subject to any disclaimer, the term of this patent is extended or adjusted under 35 U.S.C. 154(b) by 0 days.

(21) Appl. No.: 09/695,593

(22) Filed: Oct. 23, 2000

Related U.S. Application Data

(63) Continuation of application No. 09/493,698, filed on Jan. 28, 2000, which is a continuation of application No. 09/144,675, filed on Aug. 31, 1998, now Pat. No. 6,104,139.

(51) Int. Cl.[7] ..... G09G 3/10
(52) U.S. Cl. ..... 315/169.3; 313/497; 345/74
(58) Field of Search ..... 315/169.3, 169.1, 315/169.4; 313/497, 495; 345/74

(56) References Cited

U.S. PATENT DOCUMENTS

| | | | |
|---|---|---|---|
| 5,587,720 | 12/1996 | Fukuta et al. | 345/75 |
| 5,721,560 | 2/1998 | Cathey, Jr. et al. | 345/74 |
| 5,825,134 | 10/1998 | Ito | 315/169.1 |
| 5,866,979 | 2/1999 | Cathey, Jr. et al. | 313/496 |
| 5,893,967 | 4/1999 | Knall et al. | 205/640 |
| 5,938,495 | 8/1999 | Ito | 445/24 |
| 5,994,833 | 11/1999 | Seko et al. | 313/495 |
| 6,034,480 | 3/2000 | Browning et al. | 315/169.1 |
| 6,104,139 * | 8/2000 | Elloway et al. | 315/169.3 |
| 6,169,371 * | 1/2001 | Zimlich et al. | 315/169.1 |

* cited by examiner

*Primary Examiner*—Don Wong
*Assistant Examiner*—Tuyet T. Vo
(74) *Attorney, Agent, or Firm*—Wagner, Murabito & Hao LLP

(57) ABSTRACT

A method of removing contaminant particles in newly fabricated field emission displays. According to one embodiment of the present invention, contaminant particles are removed by a conditioning process which includes the steps of: a) driving a anode of a field emission display (FED) to a predetermined voltage; b) slowly increasing an emission current of the FED after the anode has reached the predetermined voltage; and c) providing an ion-trapping device for catching the ions and particles knocked off, or otherwise released, by emitted electrons. In this embodiment, by driving the anode to the predetermined voltage and by slowly increasing the emission current of the FED, contaminant particles are effectively removed without damaging the FED. The present invention also provides a method of operating FEDs to prevent gate-to-emitter current during turn-on and turn-off. In this embodiment, the method comprises the steps of: a) enabling the anode display screen; and, b) enabling the electron-emitters after the anode display screen is enabled. In this embodiment, by allowing sufficient time for the anode display screen to reach a predetermined voltage before the emitter is enabled, the emitted electrons will be attracted to the anode.

19 Claims, 8 Drawing Sheets

600

PROCEDURES AND APPARATUS FOR TURNING-ON AND TURNING-OFF ELEMENTS WITHIN A FIELD EMISSION DISPLAY DEVICE

This application is a continuation of and claims the benefit of application Ser. No. 09/493,698, filed Jan. 28, 2000, which is a continuation of and claims the benefit of application Ser. No. 09/144,675, filed on Aug. 31, 1998, and now U.S. Pat. No. 6,104,139 issued Aug. 15, 2000.

FIELD OF THE INVENTION

The present invention pertains to the field of flat panel display screens. More specifically, the present invention relates to the field of flat panel field emission display screens.

BACKGROUND OF THE INVENTION

Flat panel field emission displays (FEDs), like standard cathode ray tube (CRT) displays, generate light by impinging high energy electrons on a picture element (pixel) of a phosphor screen. The excited phosphor then converts the electron energy into visible light. However, unlike conventional CRT displays which use a single or in some cases three electron beams to scan across the phosphor screen in a raster pattern, FEDs use stationary electron beams for each color element of each pixel. This requires the distance from the electron source to the screen to be very small compared to the distance required for the scanning electron beams of the conventional CRTs. In addition, FEDs consume far less power than CRTs. These factors make FEDs ideal for portable electronic products such as laptop computers, pocket-TVs, personal digital assistants, and portable electronic games.

One problem associated with the FEDs is that the FED vacuum tubes may contain a minute amount of contaminants which can become attached to the surfaces of the electron-emissive elements, faceplates, gate electrodes (including dielectric layer and metal layer) and spacer walls. These contaminants may be knocked off when bombarded by electrons of sufficient energy. Thus, when an FED is switched on or switched off, there is a high probability that these contaminants may form small zones of high ionic pressure within the FED vacuum tube. In addition to the fact that the gate is positive with respect to the emitter, the presence of the high ionic pressure facilitates electron emission from emitters to gate electrodes. The result is that some electrons may strike the gate electrodes rather than the display screen. This situation can lead to overheating of the gate electrodes. The emission to the gate electrodes can also affect the voltage differential between the emitters and the gate electrodes. In addition, as the electrons jump the gap between the electron-emissive elements and the gate electrode, a luminous discharge of current may also be observed. Severe damage to the delicate electron-emitters may also result. Naturally, this phenomenon, generally known as "arcing," is highly undesirable.

Conventionally, one method of avoiding the arcing problem is by manually scrubbing the FED vacuum tubes to remove contaminant material. However, it is difficult to remove all contaminants with that method. Further, the process of manual scrubbing is time-consuming and labor intensive, unnecessarily increasing the fabrication cost of FED screens.

Accordingly, the present invention provides an improved method of removing contaminant particles from the FED screen. The present invention also provides for an improved method of operating field emission displays to prevent gate-to-emitter currents during turn-on and turn-off. These and other advantages of the present invention not specifically described above will become clear within discussions of the present invention herein.

SUMMARY OF THE DISCLOSURE

The present invention provides for a method of removing contaminant material in newly fabricated field emission displays. According to one embodiment of the present invention, contaminant particles are removed by a conditioning process, which includes the steps of: a) driving an anode of a field emission display (FED) to a predetermined voltage; b) slowly increasing an emission current of the FED after the anode has reached the predetermined voltage; and c) providing an ion-trapping device for catching the ions and contaminants knocked off by emitted electrons. In this embodiment, by driving the anode to the predetermined voltage and by slowly increasing the emission current of the FED, contaminant particles are effectively removed without damaging the FED.

The present invention also provides for a method of operating FEDs to prevent gate-to-emitter current during turn-on and turn-off. In this embodiment, the method includes the steps of: a) enabling the anode display screen; and, b) enabling the electron-emitters a predetermined time after the anode display screen is enabled. In this embodiment, by allowing sufficient time for the anode display screen to reach a predetermined voltage before the emitter is enabled, the emitted electrons will be attracted to the anode. In this way, gate-to-emitter current is effectively eliminated when an FED is turned on. In the present embodiment, the anode display screen is enabled by applying a predetermined high voltage to the display screen, and the electron-emitters are enabled by driving appropriate voltages to the gate electrodes and emitter electrodes of the FED.

In yet another embodiment of the present invention, the method of operating field emission displays to prevent gate-to-emitter current includes the steps of: a) disabling the emitters for a predetermined time; and, b) disabling the anode display screen after the electron-emitters are disabled. In this embodiment, by allowing sufficient time for the electron-emitters to be disabled before disabling the anode display screen, all remaining electrons will be attracted to the anode. In this way, gate-to-emitter current is eliminated during a turn-off sequence of the FED. In the present embodiment, the anode display screen is disabled by applying a ground voltage to the anode of the FED, and the electron-emitters are disabled by driving the gate electrodes and the emitter electrodes to the ground voltage.

Embodiments of the present invention include the above and further include a method of operating a field emission display, the method comprising the steps of: providing the field emission display with electron-emissive elements for emitting electrons, a gate electrode for controlling electron emission from the electron-emissive elements, and a display screen for collecting the electrons; enabling the display screen to establish a voltage differential between the display screen and the electron-emissive elements; and following enabling of the display screen, enabling the gate electrode by delaying substantial electron emission from the electron-emissive elements until the voltage differential has been established to direct the electrons towards the display screen and to substantially prevent the electrons from striking the gate electrode.

Embodiments of the present invention further include a field emission display device comprising: a baseplate; a plurality of electron-emissive elements on the baseplate; a gate electrode on the baseplate for controlling electron emission from the electron-emissive elements; a display screen spaced from the baseplate and configured for collecting electrons emitted from the electron-emissive elements to generate an image thereon; and a control circuit configured to control a flow of electrons to the electron-emissive elements, the control circuit allowing a voltage differential to be established between the display screen and the electron-emissive elements prior to substantial electron emission from the electron-emissive elements to prevent substantial gate-to-emitter current during turn on of the field emission display device.

BRIEF DESCRIPTION OF THE DRAWINGS

The accompanying drawings, which are incorporated in and form a part of this specification, illustrate embodiments of the present invention and, together with the description, serve to explain the principles of the invention.

DETAILED DESCRIPTION OF THE PREFERRED EMBODIMENTS

Reference will now be made in detail to the present embodiments of the invention, examples of which are illustrated in the accompanying drawings. While the invention will be described in conjunction with the present embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following description, for purposes of explanation, numerous specific details are set forth in order to provide a thorough understanding of the present invention. It will be apparent, however, to one skilled in the art, upon reading this disclosure, that the present invention may be practiced without these specific details. In other instances, well-known structures and devices are not described in detail in order to avoid obscuring aspects of the present invention.

General Description of Field Emission Displays

Figure 1:
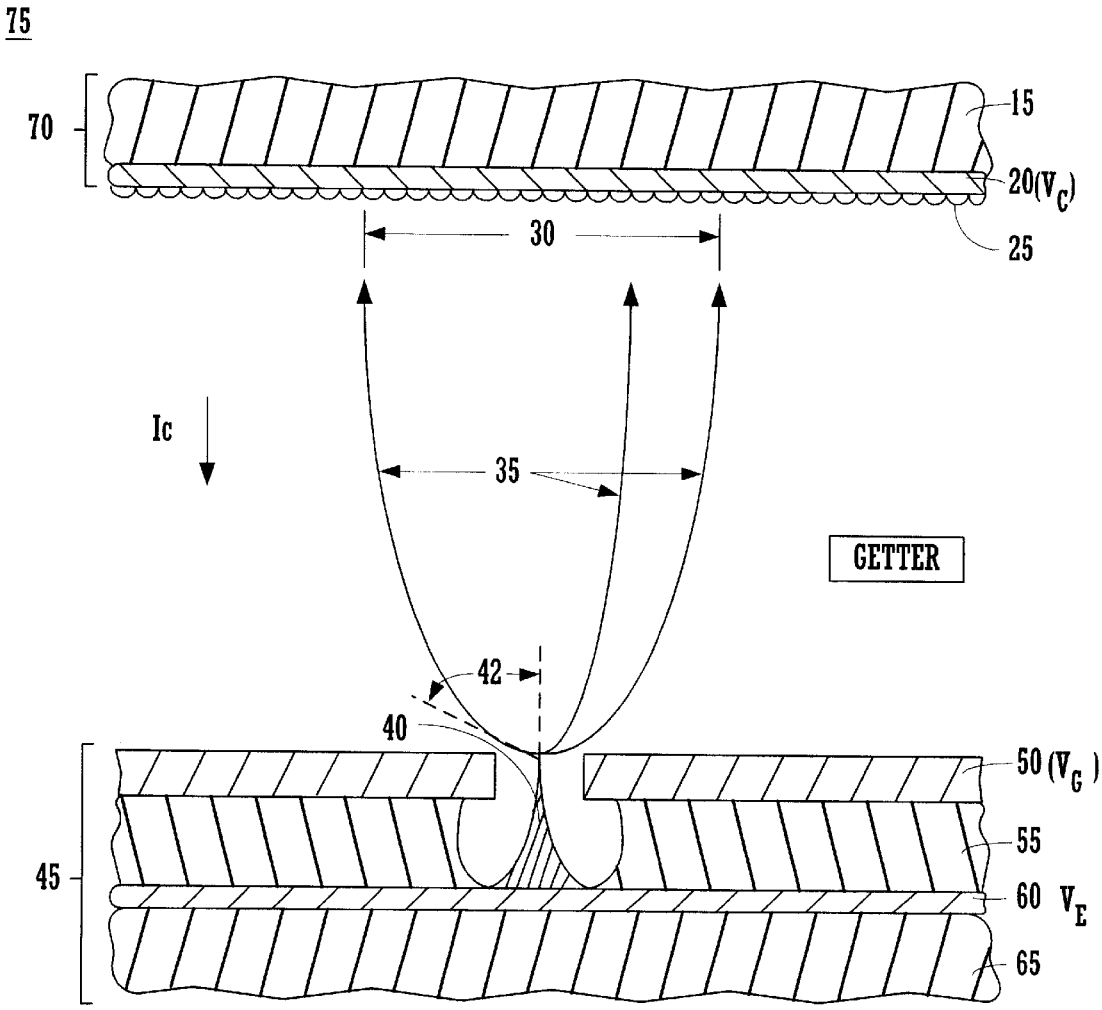
FIG. 1 is a cross section structural view of part of an exemplary flat panel FED screen that utilizes a gated field emitter situated at the intersection of a row line and a column line.

A general description of field emission displays is presented. FIG. 1 illustrate a multi-layer structure 75 which is a cross-sectional view of a portion of an FED flat panel display. The multi-layer structure 75 contains a field-mission backplate structure 45, also called a baseplate structure, and an electron-receiving faceplate structure 70. An image is generated at faceplate structure 70. Backplate structure 45 commonly consists of an electrically insulating backplate 65, an emitter (or cathode) electrode 60, an electrically insulating layer 55, a patterned gate electrode 50, and a conical electron-emissive element 40 situated in an aperture through insulating layer 55. One type of electron-emissive element 40 is described in U.S. Pat. No. 5,608,283, issued on Mar. 4, 1997 to Twichell et al. and another type is described in U.S. Pat. No. 5,607,335, issued on Mar. 4, 1997 to Spindt et al., which are both incorporated herein by reference. The tip of the electron-emissive element 40 is exposed through a corresponding opening in gate electrode 50. Emitter electrode 60 and electron-emissive element 40 together constitute a cathode of the illustrated portion 75 of the FED flat panel display. Faceplate structure 70 is formed with an electrically insulating faceplate 15, an anode 20, and a coating of phosphors 25. Electrons emitted from element 40 are received by phosphors portion 30. In one embodiment, electron emissive element 40 includes a conical molybdenum tip. In other embodiments of the present invention, the anode 20 may be positioned over the phosphors 25, and the emitter 40 may include other geometrical shapes such as a filament.

The emission of electrons from the electron-emissive element 40 is controlled by applying a suitable voltage ($V_G$) to the gate electrode 50. Another voltage ($V_E$) is applied directly to the electron-emissive element 40 by way of the emitter electrode 60. Electron emission increases as the gate-to-emitter voltage, e.g., $V_G$ minus $V_E$, or $V_{GE}$, is increased. Directing the electrons to the phosphor 25 is performed by applying a high voltage ($V_C$) to the anode 20. When a suitable gate-to-emitter voltage $V_{GE}$ is applied, electrons are emitted from electron-emissive element 40 at various values of off-normal emission angle theta 42. The emitted electrons follow non-linear (e.g., parabolic) trajectories indicated by lines 35 in FIG. 1 and impact on a target portion 30 of the phosphors 25. Thus, $V_G$ and $V_E$ determine the magnitude of the emission current ($I_C$), while the anode voltage $V_C$ controls the direction of the electron trajectories for a given electron emitted at a given angle.

Figure 2:
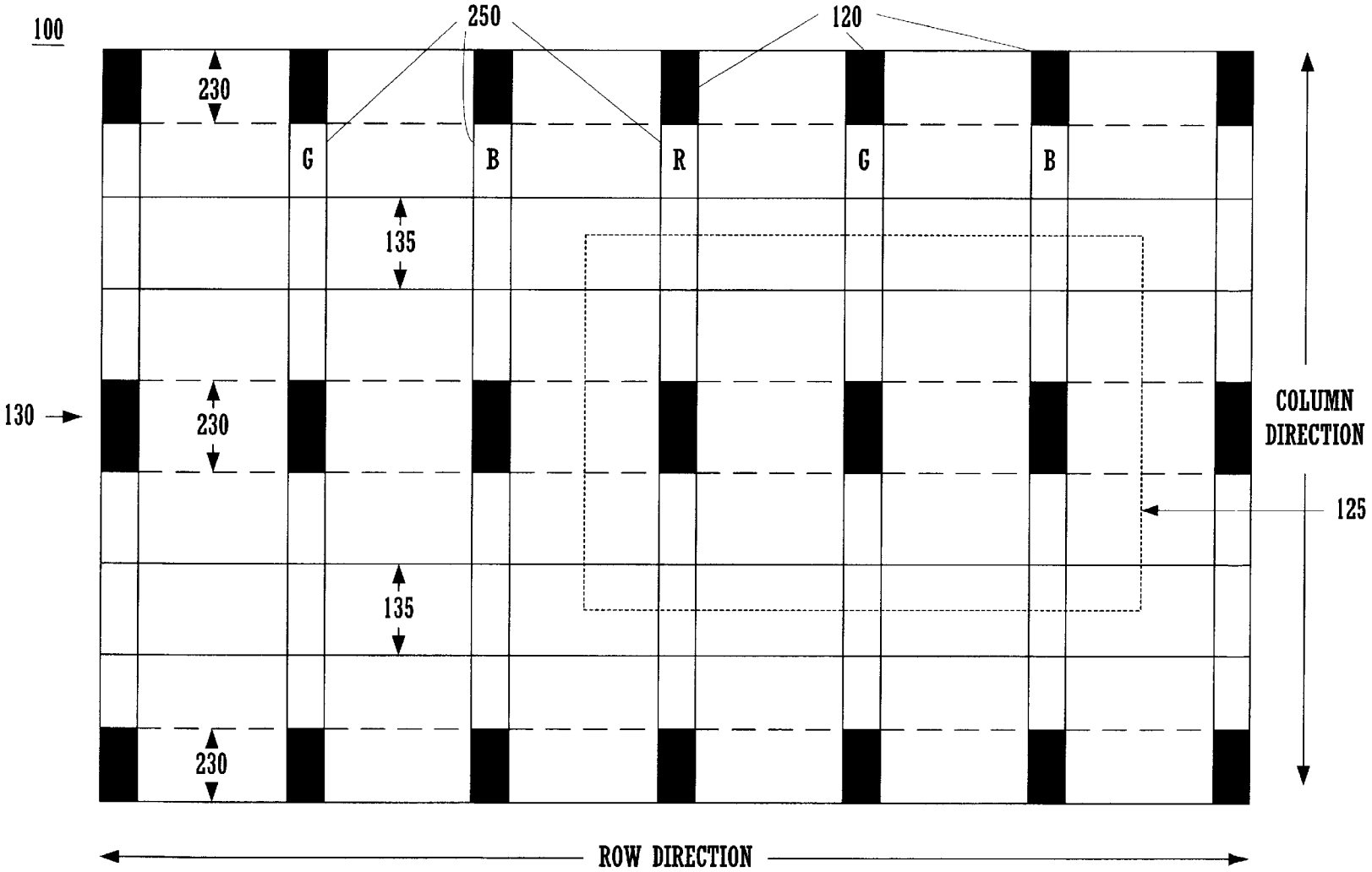
FIG. 2 illustrates an exemplary FED screen in accordance with one embodiment of the present invention.

FIG. 2 illustrates a portion of an exemplary FED screen 100. The FED screen 100 is subdivided into an array of horizontally aligned rows and vertically aligned columns of pixels. The boundaries of a respective pixel 125 are indicated by dashed lines. Three separate row lines 230 are shown. Each row line 230 is a row electrode for one of the rows of pixels in the array. In one embodiment, each row line 230 is coupled to the emitter cathodes of each emitter of the particular row associated with the electrode. A portion of one pixel row is indicated in FIG. 2 and is situated between a pair of adjacent spacer walls 135. In other embodiments, spacer walls 135 need not be between each row. And, in some displays, space walls 135 may not be present. A pixel row includes all of the pixels along one row line 230. Two or more pixels rows (and as much as 24–100 pixel rows), are generally located between each pair of adjacent spacer walls 135.

In color displays, each column of pixels has three column lines 250: (1) one for red; (2) a second for green; and (3) a third for blue. Likewise, each pixel column includes one of each phosphor stripes (red, green, blue), three stripes total. In a monochrome display, each column contains only one stripe. In the present embodiment, each of the column lines 250 is coupled to the gate electrode of each emitter structure of the associated column. Further, in the present embodiment, the column lines 250 for coupling to column driver circuits (not shown) and the row lines 230 are for coupling to row driver circuits (not shown).

In operation, the red, green and blue phosphor stripes are maintained at a high positive voltage relative to the voltage of the emitter-cathode 60/40. When one of the sets of electron emission elements is suitably excited by adjusting the voltage of the corresponding row lines 230 and column lines 250, elements 40 in that set emit electrons which are accelerated toward a target portion 30 of the phosphors in the corresponding color. The excited phosphors then emit light. During a screen frame refresh cycle (performed at a rate of approximately 60 Hz in one embodiment), only one row is active at a time and the column lines are energized to illuminate the one row of pixels for the on-time period. This is performed sequentially in time, row by row, until all pixel rows have been illuminated to display the frame. The above FED configuration is described in more detail in the following United States Patents: U.S. Pat. No. 5,541,473 issued on Jul. 30, 1996 to Duboc, Jr. et al.; U.S. Pat. No. 5,559,389 issued on Sep. 24, 1996 to Spindt et al.; U.S. Pat. No. 5,564,959 issued on Oct.15, 1996 to Spindt et al.; and U.S. Pat. No. 5,578,899 issued Nov. 26, 1996 to Haven et al., which are incorporated herein by reference.

Fed Conditioning Procedure According to One Embodiment of the Present Invention The present invention provides for a process of conditioning newly fabricated FEDs to remove contaminant particles contained therein. The conditioning process is performed before the FED device is used in normal operations, and is typically performed during manufacturing. During the conditioning process of the present invention, contaminants contained in the vacuum tube of an FED are bombarded by a large amount of electrons. As a result of the bombardment, the contaminants will be knocked off and collected by a gas-trapping device (e.g., a getter). Because newly fabricated FEDs contain a large amount of contaminants, precautions steps must be taken to ensure that arcing does not occur during the conditioning process in accordance with the present invention. To this end, according to the present invention, the conditioning process includes the step of driving the anode to a predetermined high voltage and the step of enabling the emission cathode thereafter to ensure that the electrons are pulled to the anode. In furtherance of one embodiment of the present invention the emission current is slowly increased to the maximum value after the anode voltage has reached the predetermined high voltage.

Figure 3:
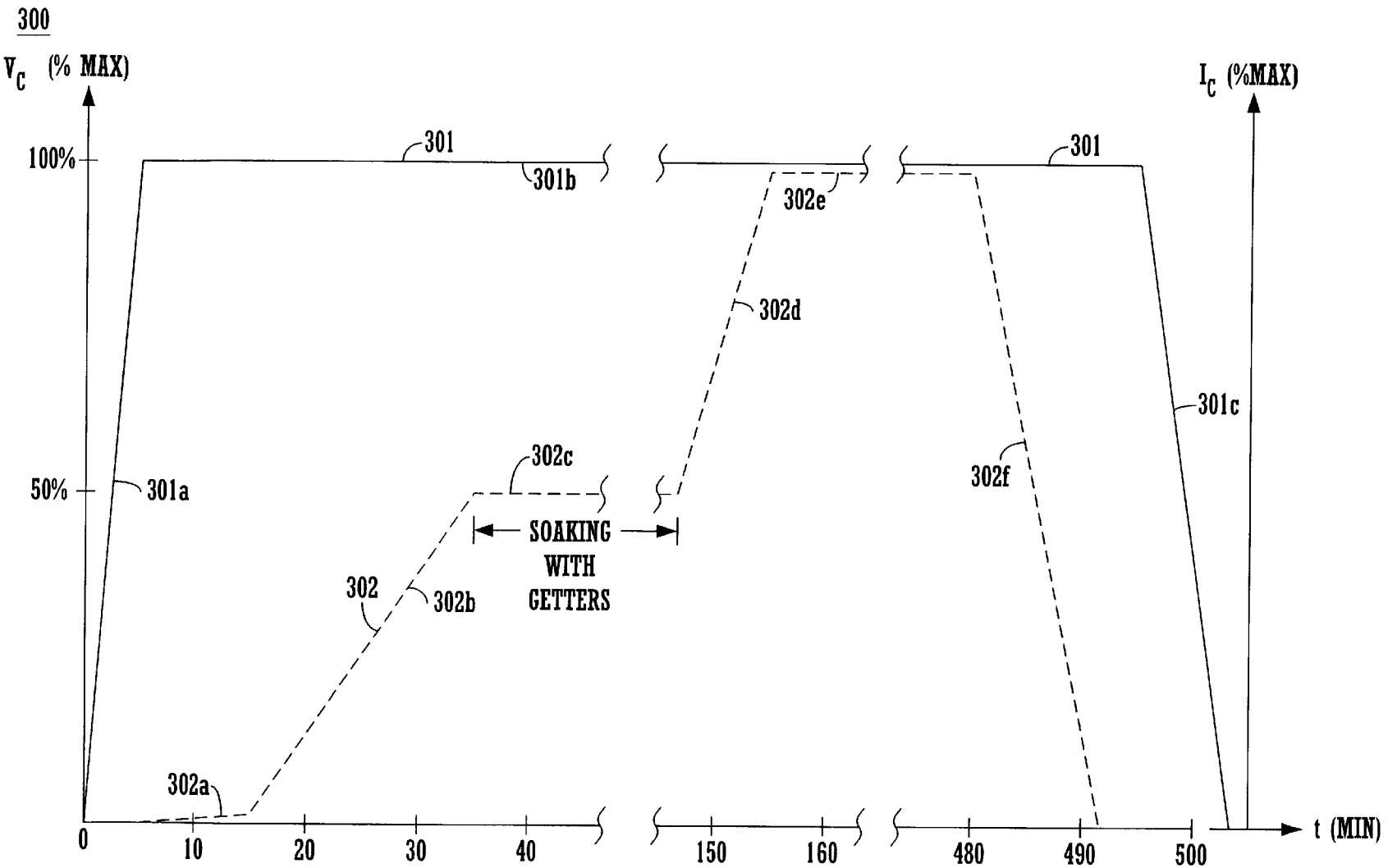
FIG. 3 illustrates a voltage and current application technique for turning-on an FED device according to one embodiment of the present invention.

FIG. 3 illustrates a plot 300 showing the changes in anode voltage level and emission current level of a particular FED during the conditioning process of the present embodiment. Plot 301 illustrates the changes in anode voltage ($V_C$), and plot 302 illustrates the changes in emission current ($I_C$). Particularly, $V_C$ is represented as a percentage of a maximum anode voltage provided by the driver electronics. For instance, for a high voltage phosphor, a maximum anode voltage may be 3,000 volts. It should be noted that the maximum anode voltage may not be the normal operational voltage of the anode. For example, the normal operational voltage of the display screen may be 25% to 75% of the maximum anode voltage. $I_C$ is represented as a percentage of a maximum emission current provided by the driver circuits of the FED. Driver electronics and electronic equipment for providing high voltages and large currents to FEDs are well known in the art, and are therefore not discussed herein to avoid obscuring aspects of the present invention.

According to the present invention, plot 301 includes a voltage ramp segment 301*a*, a first level segment 301*b*, and a voltage drop segment 301*c*; and plot 302 includes a first current ramp segment 302*a*, a second current ramp segment 302*b*, a second level segments 302*c*, a third current ramp segment 302*d*, a third level segment 302*e*, and a current drop segment 302*f*. In the particular embodiment as shown, in the voltage ramp segment 301*a*, $V_C$ increases from 0% to 100% of the maximum anode voltage over a period of approximately 5 minutes. Significantly, $I_C$, remains at 0% as $V_C$ increases to ensure that the electrons are pulled towards the display screen (anode) instead of the gate electrodes.

After $V_C$ has reached 100% of the maximum anode voltage, $V_C$ is maintained at that voltage level for roughly 25 minutes. Contemporaneously, $I_C$ is slowly increased from 0% to 1% of the maximum emission current over approximately 10 minutes (first current ramp segment 302*a*). Thereafter, $I_C$ is slowly increased to 50% of the maximum emission current over approximately 20 minutes (second current ramp segment 302*b*). $I_C$ is then maintained at the 50% level for roughly 10 minutes (third level segment 302*c*). According to the present invention, $I_C$ is increased at a slow rate to avoid the formation of high ionic pressure zones formed by desorption of the electron emitters. Desorbed molecules may form small zones of high ionic pressure, which may increase the risk of arcing. Thus, by slowly increasing the emission current, the occurrence of arcing is significantly reduced.

According to FIG. 3, $I_C$ is then maintained at a constant level for approximately 10 minutes (third level segment 302*c*) for "soaking" occur. Soaking refers to the process by which contaminant particles are removed by gas-trapping devices. Gas-trapping devices, generally known as "getters," are used by the present invention at this stage of the conditioning process and are well known in the art.

In one embodiment, after the soaking period, $I_C$ is then subsequently increased to 100% of its maximum level (third current ramp 302*d*) and, thereafter, remained at that level for approximately 2 hours (fourth level segment 302*e*). Contemporaneously, $V_C$ is maintained at its maximum level. Thereafter, $V_C$ and $I_C$ are then subsequently brought back to 0 % of their respective maximum values. Significantly, as illustrated by segments 302*f* and 301*c* of FIG. 3, $I_C$ is turned off before $V_C$ is turned off. In this way, it is ensured that all emitted electrons are pulled towards the display screen (anode) and that gate-to-emitter currents are prevented.

During the conditioning process of the present invention, any knocked off or otherwise released contaminants are collected by gas-trapping devices, otherwise known as "getters." Getters, as discussed above, are well known in the art. In the particular embodiment as illustrated in FIG. 3, the total conditioning period is roughly six hours. After this conditioning period, most of the contaminants would have been knocked off and collected by the getters, and the newly fabricated FED screen would be ready for normal operation.

Figure 4:
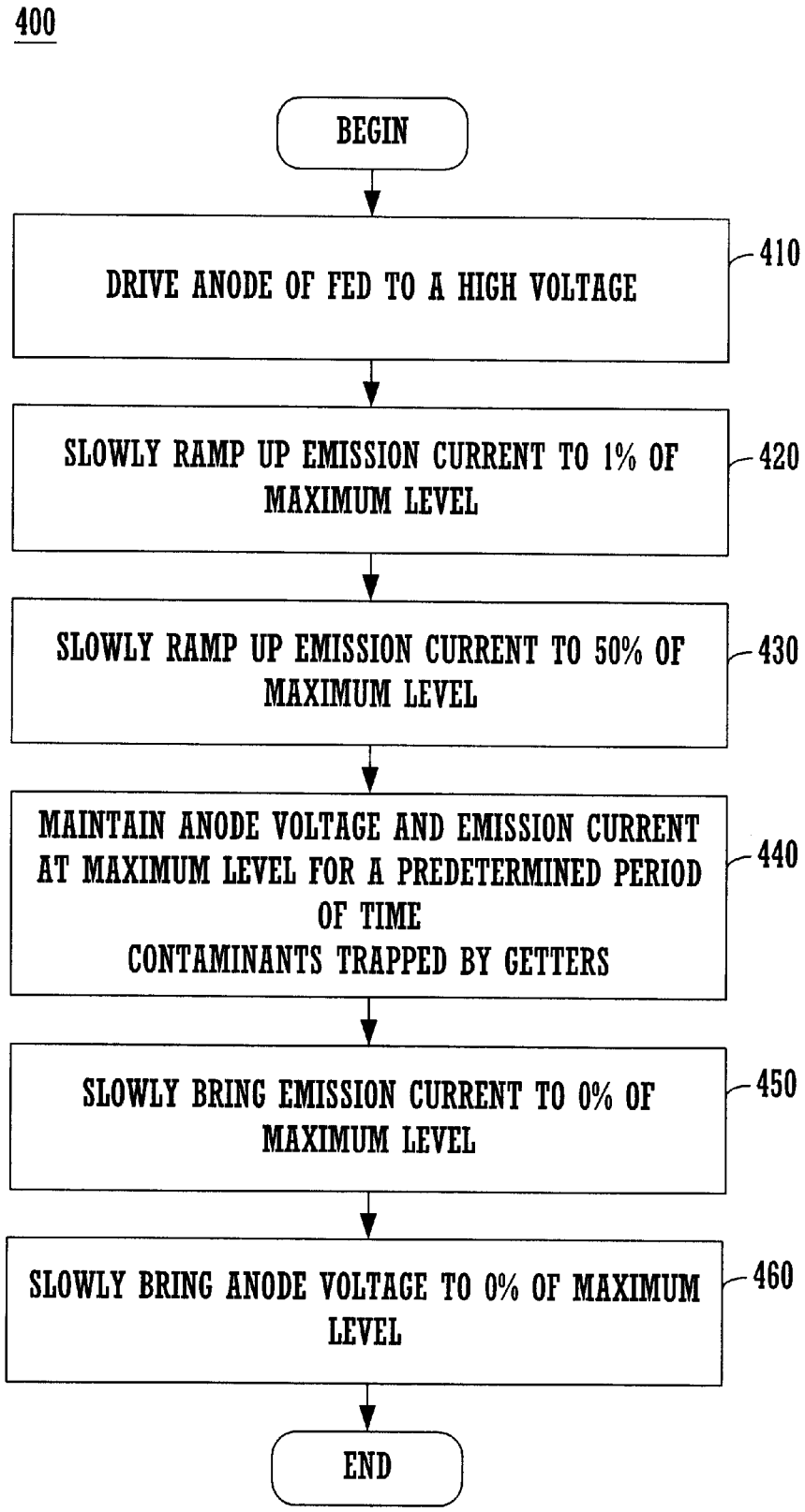
FIG. 4 illustrates a flow diagram of the steps of an FED conditioning process according to one embodiment of the present invention.

FIG. 4 is a flow diagram 400 illustrating steps of the FED conditioning process according to the present invention. To facilitate the discussion of the present invention, flow diagram 400 is described in conjunction with exemplary FED structure 75 illustrated in FIG. 1. With reference now to FIGS. 1 and 4, at step 410, the anode 20 of the FED is driven to a high voltage. It should be noted that, at step 410, the emission current ($I_C$) is maintained at 0% of the maximum level, and is therefore off. In one embodiment of the present invention, the voltage of the gate electrode 50 and the emitter-cathode 60/40 are maintained at ground. The anode voltage is driven to a high voltage while maintaining an emission current at 0% to ensure that the electrons, once emitted, are pulled to the anode 20 rather than the gate electrode 50.

At step 420 of FIG. 4, the emission current $I_C$ is slowly increased to 1% of a maximum emission current provided by driver electronics of the FED. In one particular embodiment of the present invention, step 420 takes roughly 5 minutes to accomplish. The slow ramp up ensures that localized zones of high ionic pressure will not be formed by desorption of the electron emitters. Further, in the present embodiment, the emission current $I_C$ is proportional to the gate-to-emitter voltage ($V_{GE}$) as predicted by the Fowler-Nordheim theory. Thus, in the present embodiment, the emission current $I_C$ may be controlled by adjusting the gate-to-emitter voltage $V_{GE}$.

At step 430 of FIG. 4, the emission current $I_C$ is ramped up to approximately 50% of the maximum emission current provided by driver electronics of the FED. In one embodiment, step 430 takes roughly 10 minutes to accomplish. As in step 420, the slow ramp up allows ample time for desorbed molecules to diffuse away, and ensures that localized zones of high ionic pressure are not formed.

At step 440 of FIG. 4, emission current $I_C$ and anode voltage $V_C$ are maintained at 100% of their respective maximum values such that a large amount of electrons will be emitted. The emitted electrons will bombard and knock off most loose contaminants unremoved by previous fabricating processes. The knocked off contaminants are subsequently trapped by ion-trapping devices such as the getters. As discussed above, getters are well known in the art, and are therefore not described herein to avoid obscuring aspects of the invention.

At step 450, the emission current is brought to 0% of the maximum value. Subsequently, at step 460, the anode voltage is brought to 0% of its maximum value. It is important to note that emission current is turned-off prior to turning-off the anode voltage such that all emitted electrons will be attracted to the anode. Thereafter, the conditioning process 400 ends.

Figure 5:
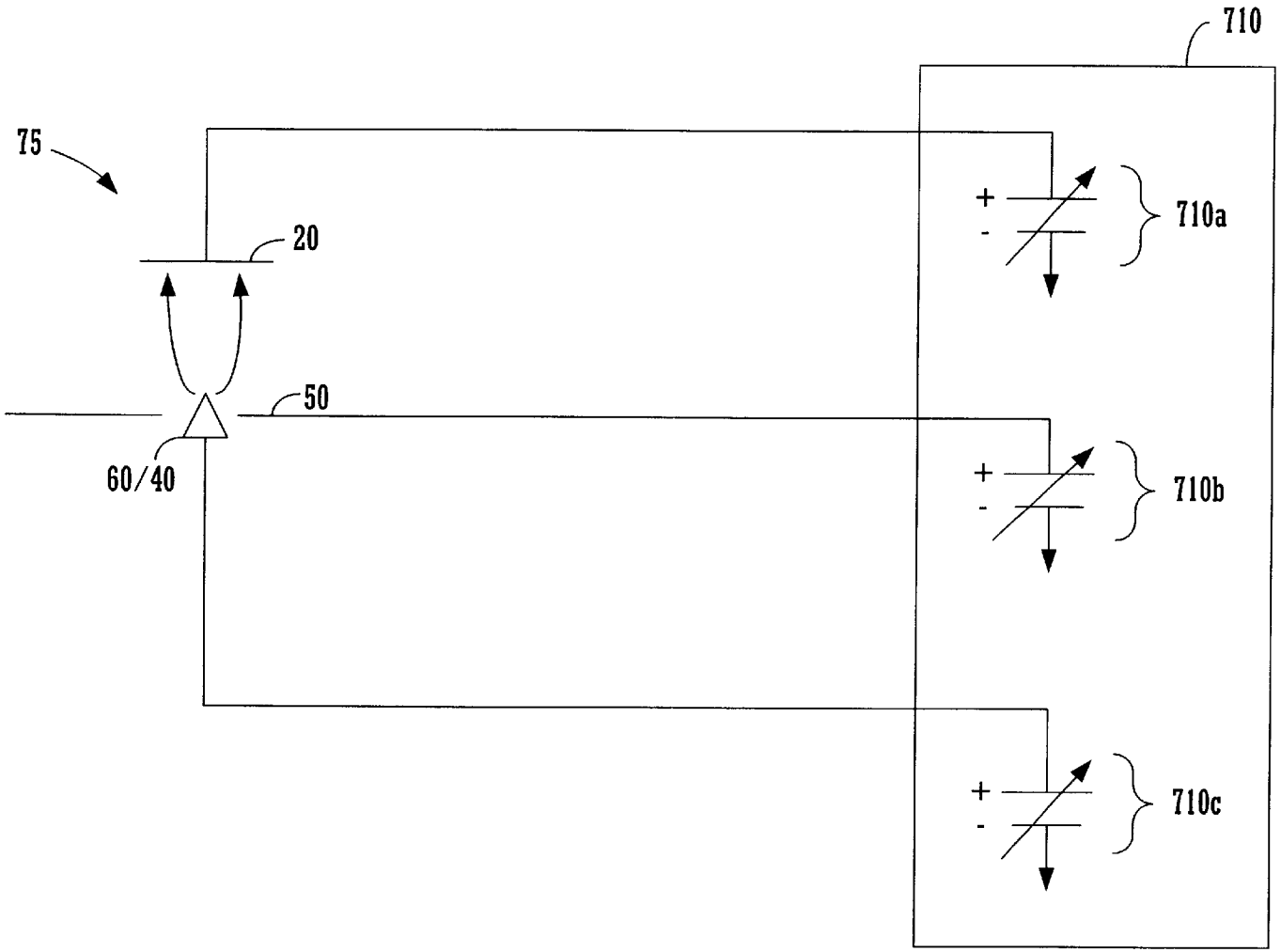
FIG. 5 illustrates a block diagram of a system for conditioning an FED according to one embodiment of the present invention.

FIG. 5 is a block diagram 700 illustrating an apparatus for controlling the conditioning process according to one embodiment of the present invention. A simplified diagram of the FED 75 of FIG. 1 is also illustrated. With reference to FIG. 5, the apparatus includes a controller circuit 710 configured for coupling to FED 75. Particularly, controller circuit 710 includes a first voltage control circuit 710*a* for providing an anode voltage to anode 20 of FED 75. Controller circuit 710 further includes a second voltage control circuit 710*b* for providing a gate voltage to gate electrode 50, and third voltage control circuit 710*c* for providing a emitter voltage to emitter cathode 60/40. It should be appreciated that the controller circuit 710 is exemplary, and that many different implementations of the controller circuit 710 may also be used.

In operation, the voltage control circuits 710*a–c* provide various voltages to the anode 20, gate electrode 50 and emitter electrode 60/40 of the FED 75 to provide for different voltages and emission current during the conditioning process of the present invention. In one embodiment of the present invention, the controller circuit 710 is a stand alone electronic equipment specially made for the present conditioning process to provide very high voltages. However, it should be appreciated that controller circuit 710 may also be implemented within an FED to control the anode voltage and emission currents during turn-on and turn-off of the FED.

Fed Turn-on and Turn-off Procedures of the Present Invention

The present invention al so provides for a method of operating a field emission display to minimize the risk of arcing during power-on and power-off of the FED unit. Particularly, according to one embodiment of the present invention, the method of operating an FED includes the steps of: turning on the anodic display screen of the FED, and, thereafter, turning on the emission cathodes. According to another embodiment of the present invention, the method of operating an FED to minimize the risk of arcing includes the steps of: turning off the emission cathodes, and thereafter, turning-off the anodic display screen. According to the present invention, the occurrence of arcing is substantially reduced by following the aforementioned steps.

Figure 6:
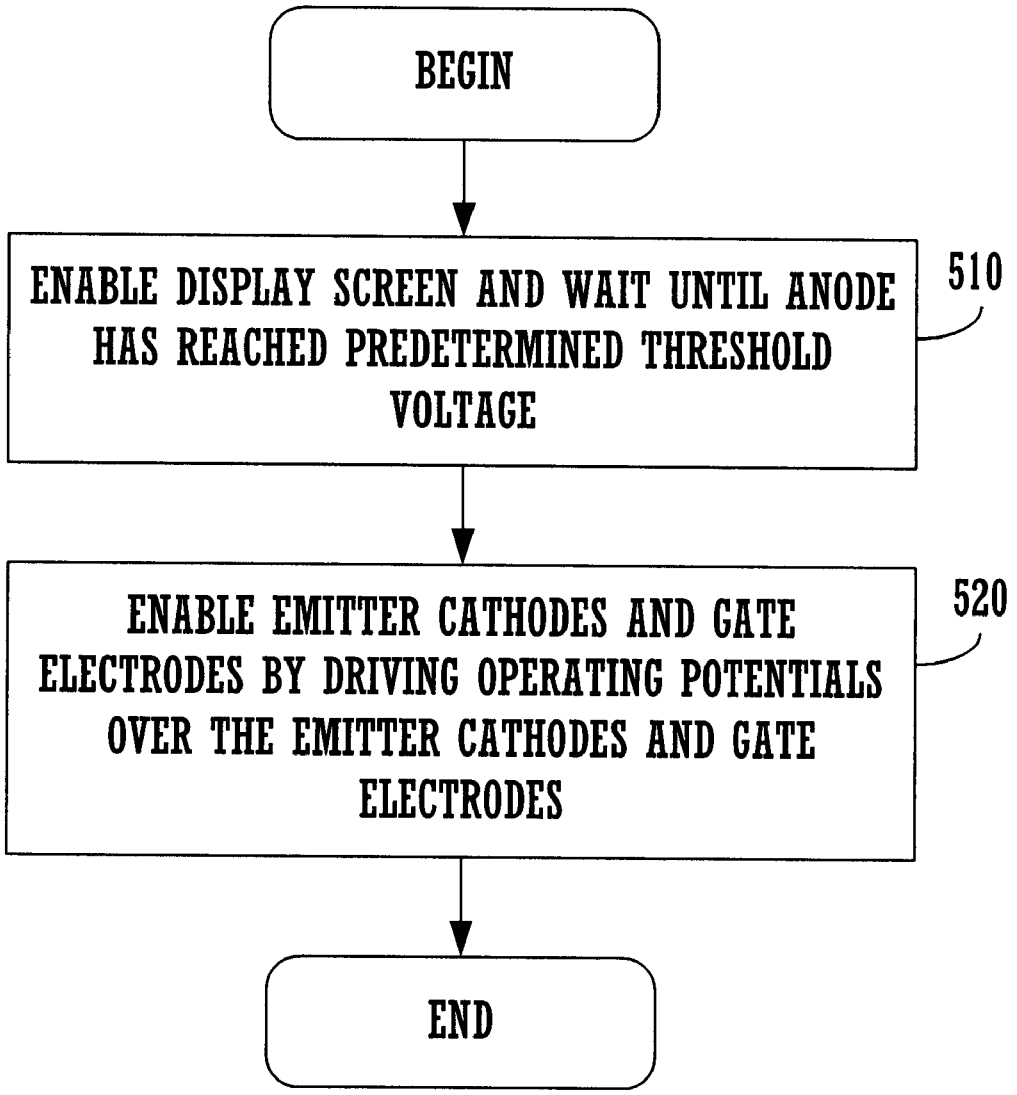
FIG. 6 illustrates a flow diagram of the steps of an FED turn-on procedure according to another embodiment of the present invention.

FIG. 6 illustrates a flow diagram 500 of steps within an FED turn-on procedure according to another embodiment of the present invention. In order to facilitate the discussion of the p resent invention, flow diagram 500 is described in conjunction with exemplary FED 75 of FIG. 1. With reference now to FIGS. 1 and 6, at step 510, when the FED 75 is switched on, the anode 20 is enabled. In the p resent embodiment, the anode is enable d by the application of a predetermined threshold voltage (e.g. 300 V). Further, in the present invention, the anode may be enabled by switching on a power supply circuit (not shown) that supplies power to the anode 20. Power supplies for FEDs are well known in the art, and any number of well know power supply devices can be used with the present invention.

At step 520, after the anode 20 of the FED 75 is enabled, and after the anode has reached the predetermined threshold voltage, the emitter cathode 60/40 and the gate electrode 50 of the FED 75 are then enabled. In the present invention, the emitter cathode 60/40 of the FED 75 is enabled a predetermined period after the anode 20 has been enabled to direct the electrons towards the anode 20 and to prevent the electrons from striking the gate electrode 50. In one embodiment, the emitter cathode 60/40 and the gate electrode 50 may be enabled by switching on the row and column driver circuits (not shown) of the FED.

Figure 7:
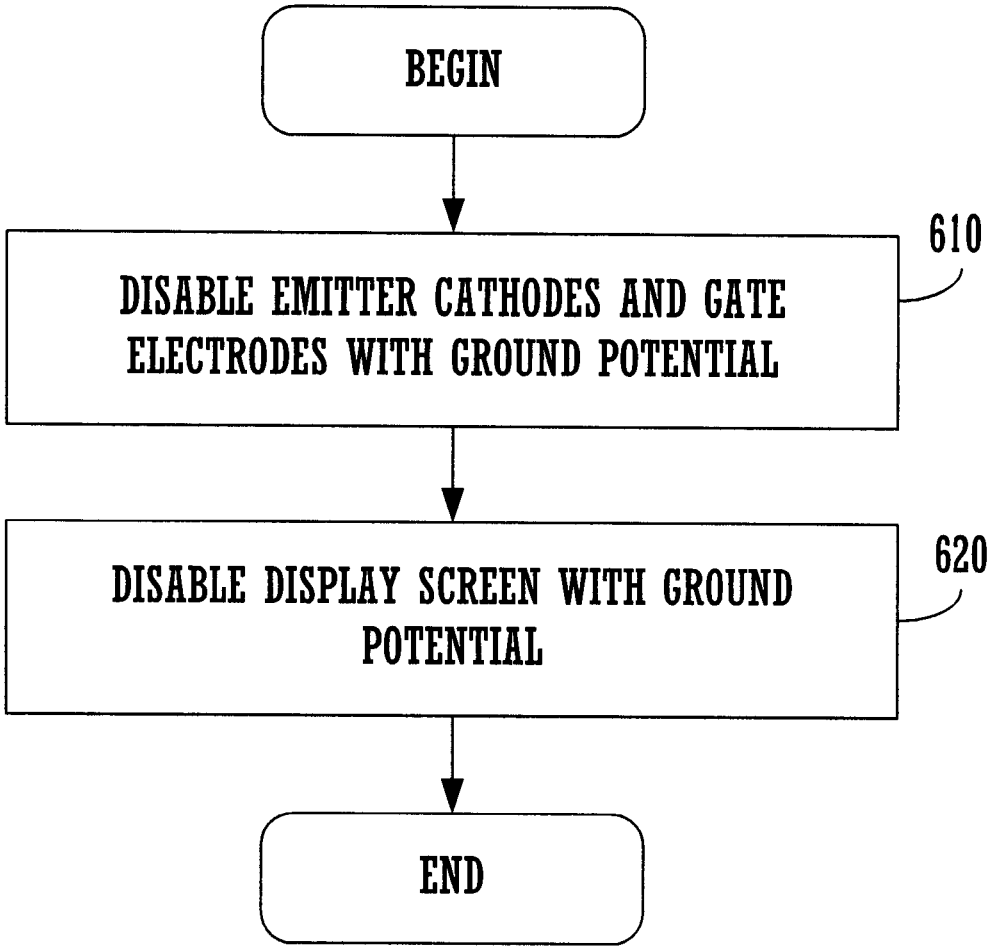
FIG. 7 illustrates a flow diagram of the steps of an FED turn-off procedure according to another embodiment of the present invention.

FIG. 7 is a flow diagram 600 illustrating steps of an FED turn-off procedure according to another embodiment of the present invention. In the following, flow diagram 600 is discussed in conjunction with exemplary FED 75 of FIG. 1. With reference now to FIGS. 1 and 7, at step 610, when the FED is switched off, the emitter cathode 60/40 and the gate electrode 50 of the FED 75 are disabled. Contemporaneously, the anode 20 remains at a high voltage. Further, in one embodiment, the emitter cathode 60/40 and gate electrode 50 are disabled by setting the row voltages and column voltages respectively provided by row drivers and column drivers (not shown) to a ground potential.

At step 620, after the emitter cathode 60/40 and the gate electrode 50 are disabled, the anode 20 of the FED is disabled. According to the present invention, step 620 is performed after step 610 in order to ensure that all electrons emitted from emission cathodes will be attracted to the anodic display screen. In one embodiment, the anode 20 is disabled by switching off the power supply circuit (not shown) that supplies power to the anode 20. In this way, the occurrence of arcing in FEDs is minimized.

Fed Conditioning Process According to Another Embodiment of the Invention

Figure 8:
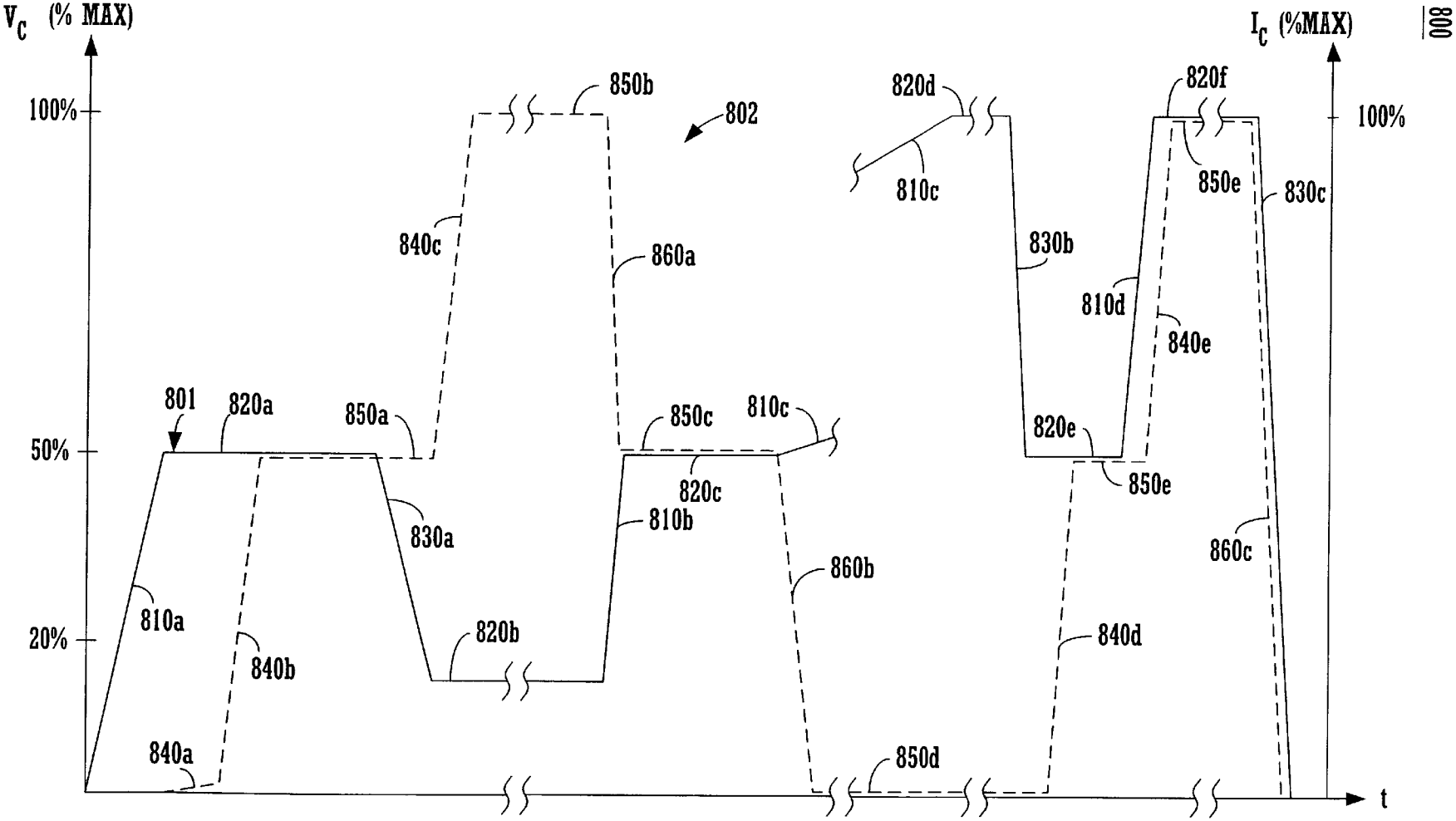
FIG. 8 illustrates a voltage and current application technique for turning-on an FED device according to another embodiment of the present invention.

FIG. 8 is a plot 800 illustrating a voltage and current application technique for conditioning a particular FED device according to another embodiment of the present invention. Plot 801 illustrates the changes in anode voltage ($V_C$), and plot 802 illustrates the changes in emission current ($I_C$). Particularly, $V_C$ is represented as a percentage of a maximum anode voltage provided by the driver electronics. $I_C$ is represented as a percentage of a maximum emission current provided by the driver circuits of the FED.

According to the present invention, plot 801 includes voltage ramp segments 810*a–d*, constant voltage segments 820*a–f*, voltage drop segments 830*a–c*; and plot 302 includes current ramp segments 840*a–e*, constant current segments 850*a–e*, and current drop segments 860*a–c*. In the particular embodiment as shown, in the voltage ramp segment 810*a*, $V_C$ increases from 0% to 50% of the maximum anode voltage over a period of approximately 10 minutes. Significantly, $I_C$ remains at 0% as $V_C$ increases to ensure that the electrons are pulled towards the display screen (anode) instead of the gate electrodes.

After $V_C$ has reached 50% of the maximum anode voltage, $V_C$ is maintained at that voltage level for roughly 30 minutes (constant voltage segment 820*a*). Contemporaneously, $I_C$ is slowly increased from 0% to 1% of the maximum emission current over approximately 10 minutes (current ramp segment 840*a*). Thereafter, $I_C$ is slowly increased to 50% of the maximum emission current over approximately 10 minutes (current ramp segment 840*b*). $I_C$ is then maintained at the 50% level for roughly 10 minutes (constant current segment 850*a*). According to the present invention, $I_C$ is increased at a slow rate to avoid the formation of high ionic pressure zones formed by desorption of the electron emitters. Desorbed molecules may form small zones of high ionic pressure, which may increase the risk of arcing. By slowly increasing the emission current, ample time is allowed for the desorbed molecules may diffuse to gas-trapping devices (e.g., getters). In this way, occurrence of arcing is significantly reduced.

According to FIG. 8, $V_C$ is reduced from 50% to 20% level (voltage drop segment 830*a*) and is maintained at the 20% level for roughly 30 minutes (constant voltage segment 820*b*). After $V_C$ has reached the 20% level, $I_C$ is slowly ramped up to the 100% level (current ramp segment 840*c*). It should be noted that the 20% level is selected such that the anode voltage is close to a minimum threshold level for the anode of the FED to attract the emitted electrons. $I_C$ is then maintained at a constant level for approximately 20 minutes (constant current segment 820*b*) for "soaking" occur.

In the present embodiment, $I_C$ is then subsequently decreased to 50% of its maximum level (current drop segment 860*a*) and, thereafter, remained at that level for approximately 20 minutes (constant current segment 850*c*). After $I_C$ has reached the 50% level, $V_C$ is increased to the 50% level (voltage ramp segment 810*b*) and is maintained at that level for 20 minutes (constant current level 820*c*). Thereafter, $I_C$ is turned-off to 0%, of its maximum value (current drop segment 860*b*).

After $I_C$ is turned off, $V_C$ is slowly ramped up to 100% of its maximum level over a period of approximately 2.5 hours (voltage ramp segment 810*c*), and is maintained at the maximum level for approximately 1 hour (constant voltage segment 820*d*). Thereafter, $V_C$ is decreased to the 50% level (voltage drop segment 830*b*), and is maintained at that level for approximately 20 minutes (constant voltage segment 820*e*). $I_C$ is slowly increased from 0% to the 50% level (current ramp 840*d*) when $V_C$ is at 50% level. $V_C$ and $I_C$. are then subsequently driven to 100% of their respective maximum values (voltage ramp segment 810*d* and current ramp segment 840*e*), and are maintained at those levels for approximately 1.5 hours (constant voltage segment 820*f* and constant current segment 850*e*). Thereafter, $V_C$ and $I_C$. are brought back to 0% (voltage drop segment 830*c* and current drop segment 860*c*).

Significantly, as illustrated by segments 810*d* and 840*e* of FIG. 8, $I_C$ is driven to the maximum value after $V_C$ is driven to the maximum value, and $I_C$ is turned off before $V_C$ is turned off. In this way, it is ensured that all emitted electrons are pulled towards the display screen (anode) and that gate-to-emitter currents are prevented.

The present invention, a method of operating an FED to minimize the occurrence of arcing in FED has thus been disclosed. It should be appreciated that electronic circuits for implementing the present invention, particularly the circuits for delaying the activation of the emissive cathode until a threshold voltage potential has been established, are well known. For instance, it should be apparent to those of ordinary skill in the art, upon reading the present disclosure, that a control circuit responsive to electronic control signals may be used to sense the anode voltage and to turn on the power supply to the row and column drivers after the anode voltage has reached a threshold value. It should also be appreciated that, while the present invention has been described in particular embodiments, the present invention should not be construed as limited by such embodiments, but rather construed according to the below claims.

What is claimed is:

1. In a field emission display having electron-emissive elements for emitting electrons, a gate electrode for controlling electron emission from the electron-emissive elements, and a display screen for collecting the electrons, a method of turning on said field emission display comprising the steps of:

a) establishing a voltage differential between said display screen and said electron-emissive elements, said step a) performed while said gate electrode is disabled;

b) directing electrons towards the display screen and substantially preventing said electrons from striking said gate electrode by enabling said gate electrode following step a), wherein substantial electron emission from said electron-emissive elements is delayed until said voltage differential has been established;

c) varying a voltage of said gate electrode to generate an emission current; and d) providing a gas-trapping device to trap any contaminants within said field emission display.

2. The method as claimed in claim 1 wherein said display screen comprises an anode.

3. The method as claimed in claim 1 wherein said step a) comprises the step of driving a predetermined anode voltage over said display screen.

4. The method as claimed in claim 1 wherein said step b) further comprises the step of driving a predetermined gate voltage over said gate electrode.

5. The method as claimed in claim 1 further comprising the steps of:

e) preventing further electron emission by disabling said gate electrode; and f) following disabling said gate electrode, disabling said display screen to prevent electrons from striking said gate electrode.

6. The method as claimed in claim 1 wherein said electron-emissive elements comprise conical electron emitters.

7. The method as claimed in claim 6 wherein said conical electron emitters each comprises a molybdenum tip.

8. A method of turning on a field emission display, said field emission display having an anode, a gate electrode and an emitter cathode, the method comprising the steps of:

driving said anode of the field emission display to a threshold voltage;

controlling an emission current of the field emission display to increase from a substantially zero level to a maximum level, wherein the step of controlling is performed after the step of driving to avoid electric arcs in the field emission display when the field emission display is initially turned on; and providing a gas-trapping device to trap any contaminants within said field emission display.

9. The method according to claim 8 wherein said step of controlling said emission current comprises the step of applying appropriate voltages to said gate electrode and said emitter cathode.

10. The method according to claim 8 further comprising the steps of:

decreasing said emission current of said field emission display from said maximum level to said substantially zero level; and disabling said anode of said field emission display, wherein the step of decreasing is performed prior to the step of disabling to direct the electrons towards the anode and to prevent the electrons from striking the gate electrode when the field emission display is turned off.

11. The method according to claim 8 wherein said emitter cathode is coupled to a plurality of conical electron emitters.

12. The method as claimed in claim 11 wherein said conical electron emitters each comprises a molybdenum tip.

13. A system comprising:

a) a field emission display comprising:

electron-emissive elements for emitting electrons;

a gate electrode for controlling electron emission from the electron-emissive elements;

a display screen for collecting the electrons; and a gas-trapping device for trapping any contaminants within said field emission display;

b) means for turning on said field emission display comprising:

means for establishing a voltage differential between said display screen and said electron-emissive elements;

means for directing electrons towards the display screen and for substantially preventing said electrons from striking said gate electrode by enabling said gate electrode following the establishment of said voltage differential, wherein substantial electron emission from said electron-emissive elements is delayed until said voltage differential has been established; and means for varying a voltage of said gate electrode to generate an emission current.

14. The system as claimed in claim 13 wherein said display screen comprises an anode.

15. The system as claimed in claim 13 wherein said means for enabling said display screen further comprises means for driving a predetermined anode voltage to said display screen.

16. The system as claimed in claim 13 wherein said means for directing electrons comprises means for driving a predetermined gate voltage to said gate electrode.

17. The system as claimed in claim 13 further comprising:

means for preventing further electron emission by disabling said gate electrode; and means for disabling said display screen to prevent electrons from striking said gate electrode following disabling the gate electrode.

18. The system as claimed in claim 13 wherein said electron-emissive elements comprise conical electron emitters.

19. The system as claimed in claim 18 wherein said conical electron emitters each comprises a molybdenum tip.

* * * * *